United States Patent [19]

Vos et al.

[11] Patent Number: 4,474,508

[45] Date of Patent: Oct. 2, 1984

[54] MARINE STRUCTURES

[75] Inventors: Charles J. Vos, Pijnacker; Barend J. G. van der Pot, Delft, both of Netherlands

[73] Assignee: Hollandsche Beton Maatschappij B.V., Rijswijk, Netherlands

[21] Appl. No.: 907,075

[22] Filed: May 18, 1978

[51] Int. Cl.[3] ..... E02B 17/00

[52] U.S. Cl. ..... 405/195; 52/167; 405/204; 405/211

[58] Field of Search ..... 405/195, 204, 205, 206, 405/208, 229, 211; 52/167; 403/2

[56] References Cited

U.S. PATENT DOCUMENTS

| | | | |
|---|---|---|---|
| 846,249 | 3/1907 | Seiler | 52/167 |
| 2,741,910 | 4/1956 | Thornley | 405/229 |
| 3,528,254 | 9/1970 | Graham | 405/208 |
| 4,106,301 | 8/1978 | Gerwick, Jr. | 405/195 |

*Primary Examiner*—David H. Corbin

*Attorney, Agent, or Firm*—Buell, Blenko, Ziesenheim & Beck

[57] ABSTRACT

An earthquake-resistant off-shore gravity structure which can stand on the sea bed under its own weight and the weight of any ballast carried by the structure has coupled to its undersurface a separately formed substantially flat concrete foundation grid which underlies at least a major part of the area of the undersurface of the structure, which is of a thickness substantially less than the height of the base and which has a downwardly extending projection for penetrating the sea bed. The coupling between the structure and the foundation grid is such that vertical loads on the structure are transferred through the foundation grid to the sea bed and is such that, for horizontal forces on the structure less than a predetermined maximum value, relative movement between the foundation grid and the structure is substantially prevented and, for a horizontal force equal to or in excess of said maximum value, limited relative movement between the foundation grid and the structure is permitted. Preferably, when the structure is subjected to a horizontal force of gradually increasing value, as may occur in the event of an earth tremor, when the value of the horizontal force reaches said predetermined maximum value, limited relative movement between the foundation grid and the structure is permitted without any further increase in horizontal force on the structure.

7 Claims, 7 Drawing Figures

MARINE STRUCTURES

This invention relates to a marine structure of the kind which stands on the bed of the sea or other body of water (hereinafter referred to as the sea) under its own weight and the weight of any ballast carried by the structure. Marine structures of this kind will hereinafter, for convenience, be referred to as "offshore gravity structures of the kind described". The invention is especially, but not exclusively, concerned with an offshore gravity structure of the kind described which is in the form of a platform including a hollow base and, upstanding from the base, an upper structure slimmer than the base, which platform can form a floating body for movement from one place to another and which, when required, can be sunk to stand on the bed of the sea with the upper structure protruding above the surface of the sea.

When an offshore gravity structure of the kind described standing on the sea bed is subjected to horizontal forces caused by wind, waves, current or other normal environmental conditions, the direct contact between the base of the structure and the sea bed enables these forces to be transferred through the base into the sea bed. To provide for transfer of such horizontal forces and vertical loads to the sea bed it is the general practice to provide on the undersurface of the base a downwardly extending projection or downwardly extending projections, usually in the form of a skirt or skirts, which penetrates or penetrate into the sea bed.

Where an offshore gravity structure of the kind described is standing on the sea bed in an area that is prone to earth tremors, there is a substantial risk that, in the event of a severe earthquake, the resulting seismic forces may be so large that the sea bed in the vicinity of the structure will move to such an extent as to cause inertia forces on the interface between the base and the sea bed of such magnitude that failure of the structure will occur.

It is an object of the present invention to provide an improved offshore gravity structure of the kind described which is or can be so founded on the sea bed that risk of failure of the structure under severe earthquake conditions is substantially reduced.

According to the invention the improved offshore gravity structure has coupled to the undersurface of its base a separately formed substantially flat concrete foundation grid which underlies at least a major part of the area of the undersurface of the structure, which is of a thickness substantially less than the height of the base and which has one or more than one downwardly extending projection for penetrating the sea bed, the coupling between the base and the or each foundation grid being such that vertical loads on the structure are transferred through the foundation grid to the sea bed and being such that, for horizontal forces on the structure less than a predetermined maximum value, relative movement between said foundation grid and the base is substantially prevented and, for a horizontal force equal to or in excess of said maximum value, limited relative movement between said foundation grid and the base is permitted.

Preferably, the predetermined maximum value which must be equalled or exceeded by a horizontal force on the structure for limited relative movement between the foundation grid or bodies and the base of the structure to be permitted is the maximum horizontal force caused by wind, waves and current to which the structure will be expected to be subjected under normal environmental conditions. In this way, during normal environmental conditions, relative movement between the base of the structure and the foundation grid is substantially prevented. In the event of a severe earthquake causing such movement of the sea bed that the structure is subjected to a horizontal force of gradually increasing value, when the value of this horizontal force reaches said predetermined value the foundation grid is permitted to move to a limited extent relative to the base of the structure so that the horizontal force to which the structure is subjected is limited to the maximum value the structure is designed to withstand.

Preferably, the coupling arrangement between the base of the structure and the foundation grid is such that, when a horizontal force on the structure reaches said predetermined maximum value, limited movement between the foundation grid and the base will occur without any further increase in horizontal force on the structure.

Preferably, where the base of the structure is of hollow form, the foundation grid may be of a thickness approximating to that of the bottom wall of the hollow base. Preferably the foundation grid is made of concrete.

The or each downwardly extending projection on the foundation grid is preferably a skirt open at its lowermost end.

Preferably, the base of the structure is coupled to the foundation grid at each of a plurality of positions mutually spaced over the undersurface of the base by substantially fluid-tight coupling means. The coupling means at each of these positions preferably comprises at least one substantially rigid elongate member which engages in aligned holes in the base and in the foundation grid, transversely-deformable means in one or both of said aligned holes and substantially fluid-tight sealing means positioned between the base and foundation grid and enclosing the rigid elongate member and transversely-deformable means. The arrangement is such that, under normal environmental conditions, vertical loads on the structure are transferred to the sea bed through bearings, which have a low resistance against horizontal displacement and which may or may not be incorporated in the coupling means, and horizontal forces on the structure, which are insufficient to deform the transversely-deformable means, are transferred by said means via the rigid elongate members to the sea bed so that relative movement between the base of structure and the foundation grid is prevented, and that, when the horizontal forces to which the structure is subjected reach said predetermined maximum value—as may arise in the event of an earth tremor—said transversely-deformable means are deformed to such an extent as to permit limited relative movement between the foundation grid and the base of the structure to take place.

In one preferred embodiment of the invention, the substantially rigid elongate member and transversely deformable means of each coupling means are of composite form and comprise a tube having such a wall thickness and transverse cross-sectional shape that it will be transversely deformed when the horizontal forces on the structure reach said predetermined maximum value.

In another preferred embodiment of the invention, the transversely deformable means of each coupling means is separately formed with respect to the substantially rigid elongate member and in this case the part of the elongate member that engages in a hole in the base of the structure and/or in a hole in the foundation grid is surrounded by a plurality of separately formed tubes arranged with their axes substantially parallel to the axis of the member and interposed between the member and the boundary wall of the hole, each of said tubes having such a wall thickness and transverse cross-sectional shape that it will be transversely deformed when the horizontal forces on the structure reach said predetermined maximum value.

Where the base of the structure is a hollow body, the hole is the base associated with each coupling means may extend through the bottom wall of the base. Each hole may be closed by a detachable cover whereby access is provided to the coupling means for inspection and/or replacement of the transversely-deformable means.

Although provision may be made for replacement of the transversely-deformable means of a coupling means, preferably the transversely-deformable means is of such a form that it will not be rendered completely inoperative by the horizontal forces likely to arise from an earth tremor and will still accommodate for limited relative movement between the foundation grid and the base of the structure in the event of a subsequent earth tremor at a later date.

In some circumstances, the foundation grid may be expendable and the coupling means coupling the base of a structure to the separately formed expendable foundation grid may be of such a form that the structure can be uncoupled from the foundation body or bodies and, if desired, moved to another site where it is coupled to another foundation grid before it is refounded on the sea bed. This arrangement avoids the necessity of disengaging the foundation grid and its downwardly-extending projection or projections from the sea bed.

The invention is further illustrated by a description, by way of example, of a preferred off-shore gravity structure and two forms of coupling device for use in the structure, with reference to the accompanying drawings, in which.

Figure 1:
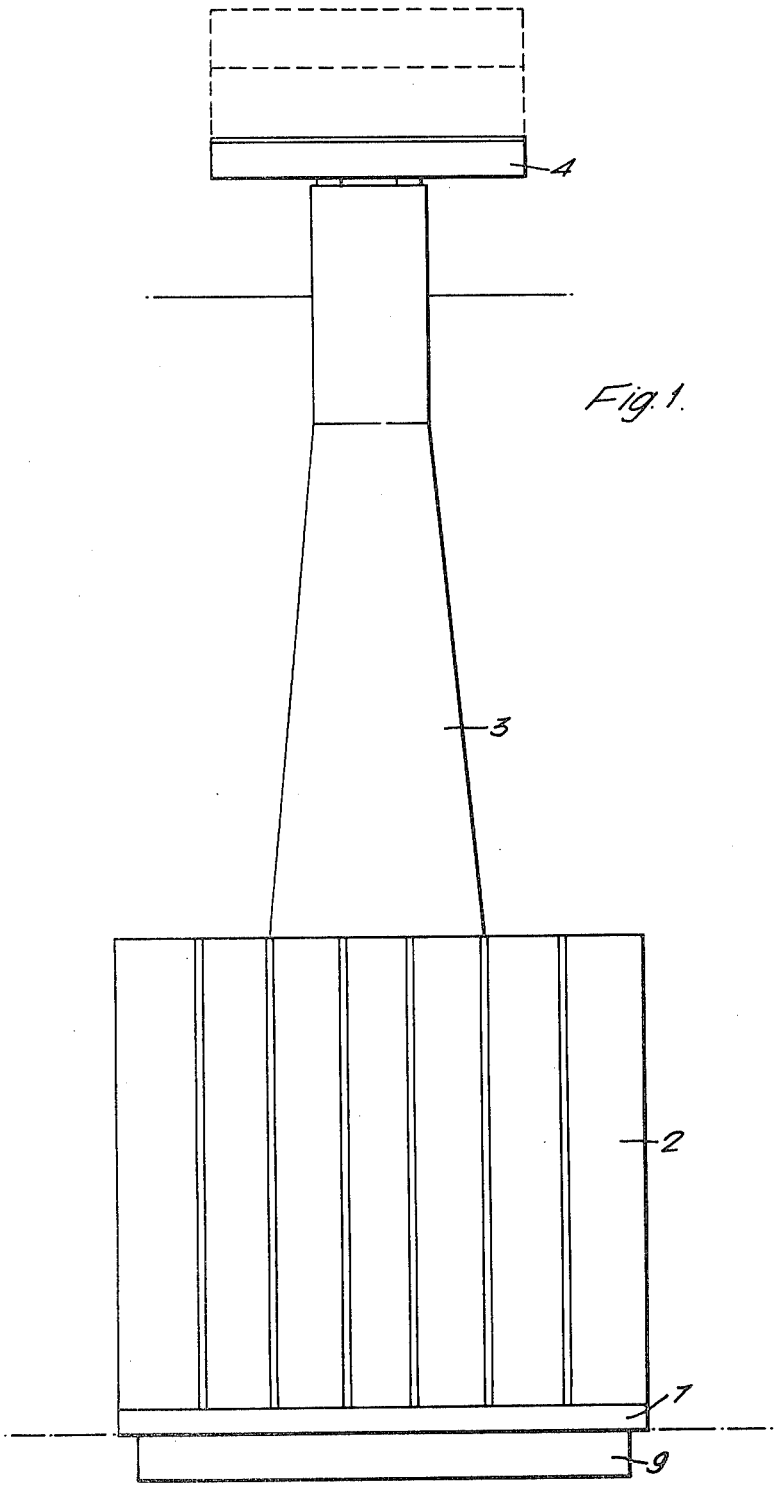
FIG. 1 is a general side view of the preferred off-shore gravity structure.
Figure 2:
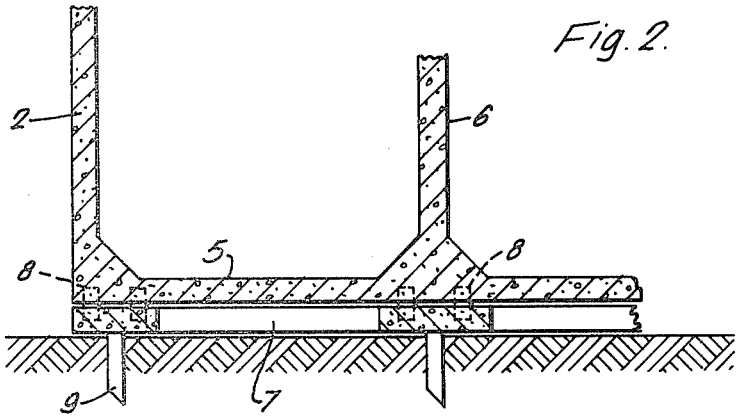
FIG. 2 is a fragmental sectional side view of the structure shown in FIG. 1.
Figure 4:
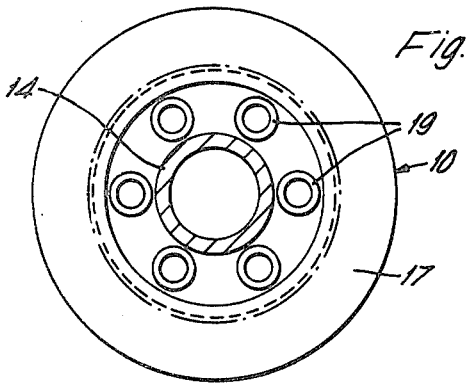
Figure 3:
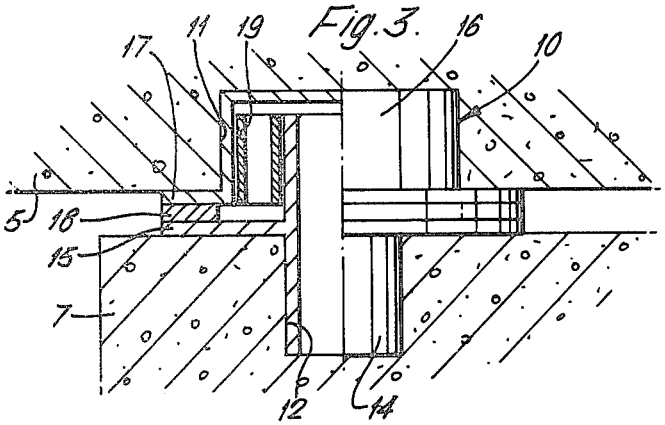
Figure 6:
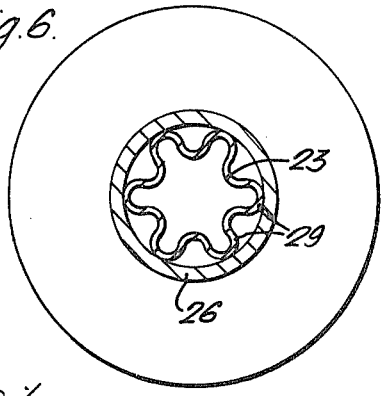
Figure 5:
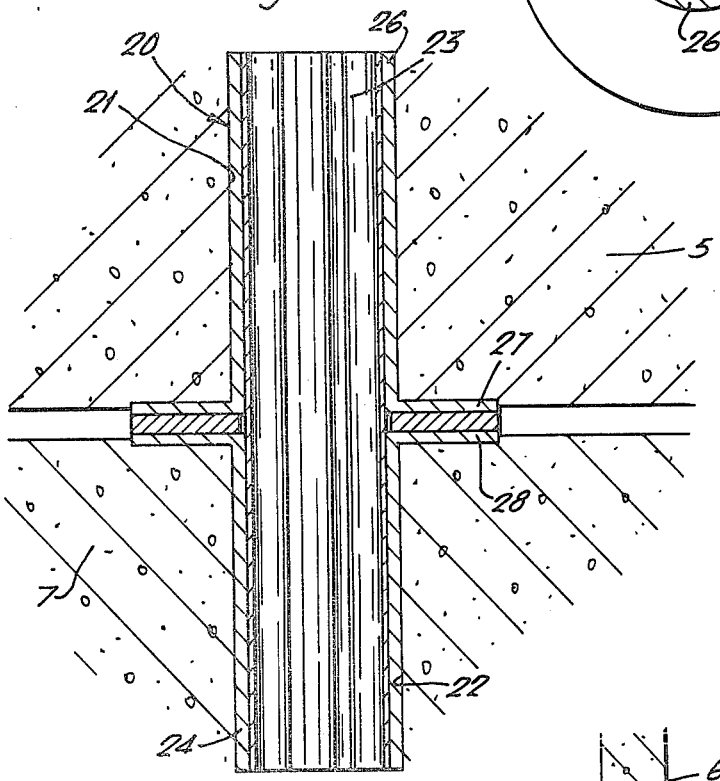
Figure 7:
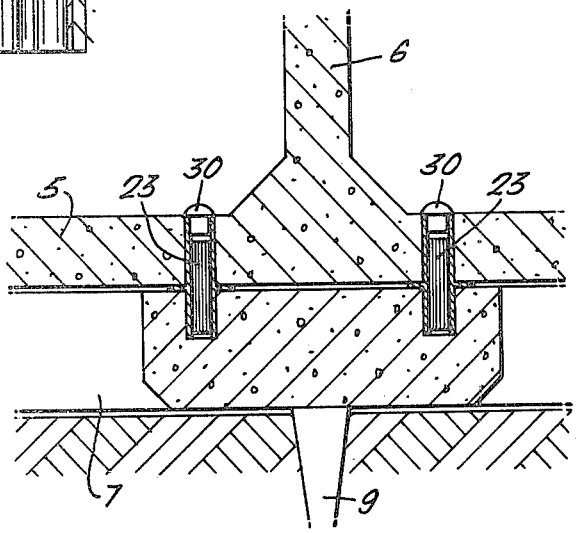

FIGS. 3 and 4, respectively, are sectional side and transverse cross-sectional views of a first form of coupling device for coupling the base and foundation body of the structure shown in FIGS. 1 and 2;

FIGS. 5 and 6, respectively, are sectional side and transverse cross-sectional views of a second form of coupling device for coupling the base and foundation body of the structure shown in FIG. 1, and FIG. 7 is a fragmental sectional side view of the structure incorporating coupling devices as shown in FIGS. 5 and 6.

Referring to FIGS. 1 and 2, the off-shore gravity structure is in the form of a platform 1 comprising a hollow concrete base 2, an upper concrete structure 3 slimmer than and upstanding from the base and, supported on the upper structure 3, a deck 4 on which the equipment, apparatus and accommodation associated with an oil rig can be supported. The interior of the hollow base 2 is subdivided into a plurality of cells by intersecting vertical walls 6 extending between the bottom wall 5 and the top wall of the base and coupled to the bottom wall 5 of the base 2 at each of a plurality of positions mutually spaced over the undersurface of the base by a coupling device 8 is a substantially flat concrete foundation grid 7 which has skirts 9 extending downwardly from the grid and penetrating the sea bed.

One form of coupling device 10 that may be employed to couple the foundation grid 7 to the bottom wall 5 of the base 2, is shown in FIGS. 3 and 4 and comprises a substantially rigid steel tube 14 which engages in aligned holes 11 and 12 in the bottom wall 5 and in the grid 7. The tube 14 is a tight fit in the hole 12 and has an integral flange 15 which bears against the upper surface of the grid 7. The hole 11 in the bottom wall 5 has a diameter substantially greater than that of the tube 14 and is lined by a steel cup 16 having a flange 17 which bears against the undersurface of the bottom wall. Fluid-tight bearings 18 interposed between the flanges 15 and 17 seal the coupling device. Spacing the tube 14 from the cup 16 lining the hole 11 are six steel tubes 19 of circular cross-section. The hole 11 may, in some circumstances, extend throughout the depth of the bottom wall 5 and may be closed by a detachable cover which can be removed to provide for inspection and/or replacement of the tubes 19.

Under normal environmental conditions vertical loads on the structure are transferred to the sea bed through the bearings 18 and horizontal forces on the structure, which are less than a predetermined maximum value, are transferred by the tubes 19 via the tubes 14 to the sea bed so that relative movement between the base 2 of the structure and the foundation grid 7 is prevented. Each of the tubes 19 is of such a wall thickness that when the horizontal forces to which the structure is subjected reach said predetermined maximum value, as may arise in the event of an earth tremor, the tubes 19 are deformed to such a extent as to permit limited relative movement between the foundation grid 7 and the base 2 to take place.

In the second form of coupling device 20 shown in FIGS. 5 to 7 that may be used to couple the foundation grid 7 to the bottom wall 5 of the base 2 of the structure, a substantially rigid steel tube 23 whose wall is so corrogated that it has a plurality of flutes 29 extending along its length engages in aligned holes 21 and 22 in the bottom wall 5 and foundation grid 7. The hole 21 is lined by a steel cup 26 having a flange 27 which bears against the undersurface of the bottom wall 5 and the hole 22 is lined by a steel cup 24 having a flange 25 which bears against the upper surface of the foundation grid 7. Fluid-tight bearings 28 interposed between the flanges 25 and 27 effectively seal the coupling device. The hole 21 in the bottom wall 5 extends throughout the depth of the wall and is closed by a detachable cover 30 which can be removed to provide for inspection and or replacement of the tube 23 and, if desired, uncoupling of the structure from the foundation grid 7.

As in the case of the coupling device shown in FIGS. 3 and 4, under normal environmental conditions vertical loads on the structure are transferred to the sea bed through bearings 28; horizontal forces on the structure, which are less than a predetermined maximum value, are transferred by the flutes 29 via the tubes 23 to the sea bed so that relative movement between the base 2 and the foundation grid is prevented. When the horizontal forces to which the structure is subjected reach said predetermined maximum value, the wall thickness of the tubes 23 is such that the tubes are deformed to such an extent as to permit limited relative movement between the foundation grid 7 and the base 2 to take place.

The concept of the present invention is especially, but not exclusively, suitable for use with an off-shore gravity structure which is in the form of a platform for the drilling for oil or other substances from the bottom of the sea and which is to be installed in areas that may be prone to earth tremors.

What we claim as our invention is:

1. An off-shore gravity structure which can stand on the sea bed under its own weight and the weight of any ballast carried by the structure, wherein a separately formed substantially flat concrete foundation grid which underlies at least a major part of the area of the undersurface of the base of the structure, which is of a thickness substantially less than the height of the base and which has at least one downwardly extending projection for penetrating the sea bed, is coupled to the base at each of a plurality of positions mutually spaced over the undersurface of the base by substantially fluid-tight coupling means comprising at least one substantially rigid elongate member which engages in aligned holes in the base and foundation grid, transversely deformable means in at least one of said aligned holes, and substantially fluid-tight sealing means which is positioned between the base and foundation grid which encloses the rigid elongate member and transversely deformable means, and which has a low resistance against horizontal displacement, the arrangement being such that under normal environmental conditions, vertical loads on the structure are transferred to the sea bed through said bearings, and horizontal forces on the structure, which are insufficient to deform the transversely deformable means, are transferred by said means via the rigid elongate members to the sea bed so that relative movement between the base of the structure and the foundation grid is prevented and being such that when the horizontal forces to which the structure is subjected reach a predetermined maximum value said transversely deformable means are deformed to such an extent as to permit limited relative movement between the foundation grid and the base of the structure to take place without any further increase in horizontal force on the structure.

2. An off-shore gravity structure as claimed in claim 1, wherein the base of the structure is a hollow body and the foundation grid is of a thickness approximating to that of the bottom wall of the hollow base.

3. An off-shore gravity structure as claimed in claim 1, wherein the structure is of concrete.

4. An off-shore gravity structure as claimed in claim 1, wherein the coupling means are of such a form that the structure can be uncoupled from the foundation grid.

5. An off-shore gravity structure as claimed in claim 1, wherein the or each downwardly extending projection on the foundation grid is a skirt open at its lowermost end.

6. An off-shore gravity structure as claimed in claim 1, wherein the structure is in the form of a platform including a hollow base and, upstanding from the base an upper structure slimmer than the base, which platform can form a floating body for movement from one place to another and which, when required, can be sunk to stand on the sea bed with the upper structure protruding above the surface of the sea.

7. An off-shore gravity structure which can stand on the sea bed under its own weight and the weight of any ballast carried by the structure, wherein a separately formed substantially flat concrete foundation grid which underlies at least a major part of the area of the undersurface of the base of the structure, which is of a thickness substantially less than the height of the base and which has at least one downwardly extending projection for penetrating the sea bed, is coupled to the base at each of a plurality of positions mutually spaced over the undersurface of the base by substantially fluid-tight coupling means comprising at least one substantially rigid elongate member which engages in aligned holes in the base and foundation grid, transversely deformable means in at least one of said aligned holes, and substantially fluid-tight sealing means which is positioned between the base and foundation grid which encloses the rigid elongate member and transversely deformable means, and which has a low resistance against horizontal displacement, the arrangement being such that under normal environmental conditions, vertical loads on the structure are transferred to the sea bed through said bearings, and horizontal forces on the structure, which are insufficient to deform the transversely deformable means, are transferred by said means via the rigid elongate members to the sea bed so that relative movement between the base of the structure and the foundation grid is prevented and being such that when the horizontal forces to which the structure is subjected reach a predetermined maximum value said transversely deformable means are deformed to such an extent as to permit limited relative movement between the foundation grid and the base of the structure to take place without any further increase in horizontal force on the structure and wherein the transversely deformable means of each coupling means is separately formed with respect to the substantially rigid elongate member and the part of the elongate member that engages in at least one of said aligned holes is surrounded by a plurality of separately formed tubes arranged with their axes substantially parallel to the axis of the member and interposed between the member and the boundary wall of the hole, each of said tubes having such a wall thickness and transverse cross-sectional shape that it will be transversely deformed when the horizontal forces on the structure reaches said predetermined maximum value.

* * * * *

UNITED STATES PATENT AND TRADEMARK OFFICE

CERTIFICATE OF CORRECTION

PATENT NO. : 4,474,508

DATED : October 2, 1984

INVENTOR(S) : CHARLES J. VOS; BAREND J. G. VAN DER POT

It is certified that error appears in the above-identified patent and that said Letters Patent is hereby corrected as shown below:

Column 1, line 67, delete "or bodies".

Column 3, line 13, change "is" to --in--.

Column 3, line 32, delete "body or bodies" and insert --grid--.

Signed and Sealed this

*Twenty-first* Day of *May 1985*

[SEAL]

*Attest:*

DONALD J. QUIGG

*Attesting Officer* *Acting Commissioner of Patents and Trademarks*